US007845123B2

(12) United States Patent
Tada

(10) Patent No.: US 7,845,123 B2
(45) Date of Patent: Dec. 7, 2010

(54) STAIRCASE BLOCK AND STAIRCASE CONSTRUCTION METHOD USING THE STAIRCASE BLOCK

(76) Inventor: Kimio Tada, 2-5-11, Kamiyabe, Sagamihara-shi, Kanagawa (JP) 2290001

( * ) Notice: Subject to any disclaimer, the term of this patent is extended or adjusted under 35 U.S.C. 154(b) by 564 days.

(21) Appl. No.: 10/582,096

(22) PCT Filed: Aug. 23, 2004

(86) PCT No.: PCT/JP2004/012057

§ 371 (c)(1),
(2), (4) Date: Jun. 8, 2006

(87) PCT Pub. No.: WO2005/093165

PCT Pub. Date: Oct. 6, 2005

(65) Prior Publication Data

US 2007/0137123 A1 Jun. 21, 2007

(30) Foreign Application Priority Data

Mar. 29, 2004 (WO) ..... PCT/JP2004/004441

(51) Int. Cl.

| | |
|---|---|
| ***E04F 11/00*** | (2006.01) |
| ***E04F 19/10*** | (2006.01) |
| ***E04B 5/04*** | (2006.01) |
| ***E04B 2/30*** | (2006.01) |
| ***E04C 2/04*** | (2006.01) |

(52) U.S. Cl. ..... 52/190; 52/182; 52/184; 52/188; 52/596

(58) Field of Classification Search ..... 52/182–191, 52/596, 503–505, 575, 608, 610

See application file for complete search history.

(56) References Cited

U.S. PATENT DOCUMENTS 1,450,404 A * 4/1923 Anderson ..... 52/190

(Continued)

FOREIGN PATENT DOCUMENTS

GB 2302343 A * 1/1997

(Continued)

OTHER PUBLICATIONS

International Search Report mailed Dec. 7, 2004 of International Application PCT/JP2004/012057.

*Primary Examiner*—Brian E Glessner
*Assistant Examiner*—Omar Hijaz
(74) *Attorney, Agent, or Firm*—Westerman, Hattori, Daniels & Adrian, LLP

(57) ABSTRACT

To reduce the weight of a staircase block so as to be manually carried and installed, prevent adjacent blocks from being displaced from each other after installation, and prevent the blocks from being raised and separated from each other due to heating and cooling by conquering problems with the staircase blocks related to publicly known technologies. In this precast concrete block for building a staircase, large recesses (2) and (9) are formed in the rise surface (1) and the rear surface (8) of the block to reduce the weight, and displacement prevention grooves (7) for connecting the adjacent blocks to each other with mortar are formed in the side faces of the block, and round parts (partially cylindrical recessed surfaces) (10) with a specified radius are formed at the inner corner parts of the recess (9) in the rear surface so that an acute angle part preventing the adhesive mortar from being filled therein is not produced.

2 Claims, 4 Drawing Sheets

U.S. PATENT DOCUMENTS

| | | | | | |
|---|---|---|---|---|---|
| 1,985,143 | A | * | 12/1934 | Buffaloe | 52/189 |
| 3,007,283 | A | * | 11/1961 | Holland | 52/190 |
| 3,021,928 | A | * | 2/1962 | Blair | 52/191 |
| 3,216,160 | A | * | 11/1965 | Best | 52/189 |
| 4,951,434 | A | * | 8/1990 | Schmidt | 52/191 |
| 6,029,408 | A | * | 2/2000 | Cavaness | 52/188 |
| 6,082,067 | A | * | 7/2000 | Bott | 52/592.3 |
| 6,176,049 | B1 | * | 1/2001 | Crant et al. | 52/188 |

FOREIGN PATENT DOCUMENTS

| | | | |
|---|---|---|---|
| JP | 100523/1981 | | 8/1981 |
| JP | 60-53130 | B | 11/1985 |
| JP | 3045821 | U | 2/1998 |

* cited by examiner

1···RISE SURFACE
2···DECORATED SURFACE (RECESS)
3···CHAMFER
4···STEPPING SURFACE
5···SIDE SURFACE
6···SLIP PREVENTION PART
7···DISPLACEMENT PREVENTION GROOVE
8···REAR SURFACE
9···REAR SURFACE RECESS
10···ROUND PART

PRIOR ART

STAIRCASE BLOCK AND STAIRCASE CONSTRUCTION METHOD USING THE STAIRCASE BLOCK

FIELD OF INVENTION

The present invention relates to a pre-cast concrete staircase block used for constructing a staircase in a construction site, and a staircase construction method using the staircase block.

BACKGROUND OF INVENTION

A staircase in a residential area has conventionally been constructed as follows: Firstly, a face of inclined land is evenly tamped, foundation concrete with reinforcement is placed on the slope, steps of the staircase are roughly formed of concrete on the foundation, and finally, faces of the roughly-formed steps are mortar finished (FIG. 4).

In the staircase built by the above conventional method, strain is often created between the roughly-formed steps and the face mortar layer, as the rate of expansion and contraction of both materials against temperature change or humidity change differ from each other. This strain causes cracks on the surface of the mortar, through which water can penetrate. Further, a slight amount of air and moisture caught under the mortar layer can cause it to be fallen off the steps because of repeated expansion of air at high temperature and of frozen water at low temperature.

For the above mentioned reasons, the conventional constructing method is not suited to cold regions where land freezes and the time when temperature difference is extremely large.

There is an improved method, compared to the conventional one, for constructing a staircase, in which an L shaped staircase block is used (FIG. 5). The L shaped staircase block is a pre-cast concrete plate block having a cross-sectional side view in which the character L is rotated by 90 degrees counter-clockwise (in a reverse L shaped staircase block, the character L is rotated by 90 degrees clockwise).

In the improved method, because the finishing mortar layer in the conventional method is replaced by the L shaped staircase block, the problem of cracks has been solved. However, a cavity in the mortar filled in the inner space of the L shaped staircase block can be produced due to insufficient filling at the corner of the block or at the joint between blocks. Expansion of air and water in the cavity is apt to cause the problem of peeling between the blocks.

Generally, as a staircase is a means for passing through an inclined land, shortening of the term of works for constructing the staircase is an absolute requirement. Specially, in a repair work for a staircase in use in a residential area, it is strongly required to shorten the term of total traffic suspension. In such a case, it is desirable to utilize the staircase under repair partly, and at the same time, a new staircase is built successively from the opposite end. However, on the basis of the conventional constructing method, it has been difficult to satisfy such requirements, due to various difficulties in the execution of works.

It is publicly known to solve the above-mentioned problems with a pre-cast concrete staircase block as disclosed in the following document (hereinafter referred to as a "prior art").

Registered utility patent No. 3045821 of Japan

However, in the prior art, such problems have undergone as that the proposed staircase block is too heavy to be handled manually, that the neighbouring blocks shift from the right position, and that a undesirable space which causes separation of the rear surface of the staircase block from the ground concrete due to air layer is likely to occur.

Problems to be Solved by Invention

Problems to be solved by the present invention are those undergone in the prior art, which should be solved by lightening the staircase block so that it can be handled manually, by considering measures to prevent neighbouring blocks from shifting from the right position, and by considering measures to prevent the staircase blocks from being loosened to be peeled off.

Measures for Solving Problems

The above problems can be solved by a light-weight block having large recesses in the rear surface and the rise surface, by a block in which acute angles at the corners in the rear surface are excluded not so as to make insufficient filling of adhesive mortar, and by a block in which grooves are formed to prevent the neighbouring blocks to shift from the right position.

ADVANTAGEOUS EFFECTS OF INVENTION

According to the present invention, the weight of the staircase block of 330 mm length is approximately 26 kg per block, which is movable enough by hands. The manual portability of the blocks is a big advantage in the situation of a inclined land where any heavy construction machines are hard to be utilized.

Because of the round parts (partially cylindrical recess surface) formed at the inner corner parts of the recess in the rear surface of the block, the mortar laid under the block leaves no unfilled vacancy, and therefore, residual air and moisture which cause expansion breakage are in hot or cold time are effectively excluded.

Weight reduction effect is increased by forming a large recess in the rise surface of the block. And, by filling mortar in the displacement prevention grooves formed on the side surfaces of the block and placing the side surface to another, a displacement prevention an effect is produced as if adjacent blocks are tied by a wedge.

DESCRIPTION OF THE PREFERRED EMBODIMENT

As an example of the preferred embodiment of the present invention, a method of constructing a staircase using the pre-cast concrete block referred to in the above is described.

A preparation step in which the face of inclined land is evenly tamped, required number of steps and rise height of each step are determined, and finished size is inked.

A first step of laying a foundation mortar on the tamped face of the inclined land, and temporarily placing the staircase blocks on the foundation mortar.

A second step of producing a gap between the rear surface of the block and the upper surface of the foundation mortar by lifting the minimum angle side of the block by 3-4 cm with a camber.

A third step of leveling the corner of the rise surface of the staircase blocks by hammering it with a sand hammer while checking the horizon with a level placed on the front edge of the stepping surface of the block.

A fourth step of adjusting the slant angle of the stepping surface of the block by pushing and pulling the camber while checking the slant angle with a slant (a slant angle measuring device).

A fifth step of filling-up uniformly the gap produced in the second step with mortar.

Sixth and seventh steps of filling-up the trace of the withdrawn camber with mortar, and inserting joint filler into the gap between adjacent blocks, and A final step of finishing the joint and completing the construction work by cleaning residual sands and dusts.

EXAMPLES

FIG. 1 shows a perspective view, a plan, a front view, a rear view, a side view, a sectional view, and a back-side view of the staircase block as an example of the present invention. In FIG. 1, FIG. 1A is the perspective view, B is the plan, C is the front view, D is the rear view, E is the side view, F is the sectional view, and G is the back-side view of the staircase block.

A reference sign 1 shown in FIG. 1 represents a rise surface, 2 a recess in the middle of the rise surface, 3 a chamfer between a stepping surface and the rise surface, 4 the stepping surface, 5 a side surface, 6 slip prevention grooves, 7 displacement prevention grooves, 8 a back-side surface, 9 a recess in the back-side surface, and 10 round parts in the back-side recess.

FIG. 2 is a sectional view showing a total structure of a staircase constructed using the staircase block shown in FIG. 1. Mortar is laid on a foundation of concrete with reinforcement, and the staircase blocks are arranged on the mortar. Pine or H-Steel may be included in the mortar if required.

(1) to (3) of FIG. 3 are measurements of respective parts. Main measurements a-g shown in the perspective view (1) of FIG. 1 are tabulated. Other detail measurements are shown in respective parts drawings (2) to (9). (2) of FIG. 3 shows the part of the stepping surface 4, (3) the rise surface 1, (4) the back-side surface 8, (5)-(7) the side surface 5, (8) the displacement prevention grooves 7, and (9) the recess in the back-side surface.

INDUSTRIAL USABILITY OF THE INVENTION

As the present invention relates to a staircase block which is one of construction material used in construction works for constructing staircases in dowelling sites and others, the present invention is looked forward to contributing in developments of concrete ware manufacturing industry, civil engineering and architectural industries, and other related industries.

BRIEF EXPLANATIONS OF THE DRAWING

EXPLANATION FOR REFERENCE SIGNS

Figure 1:
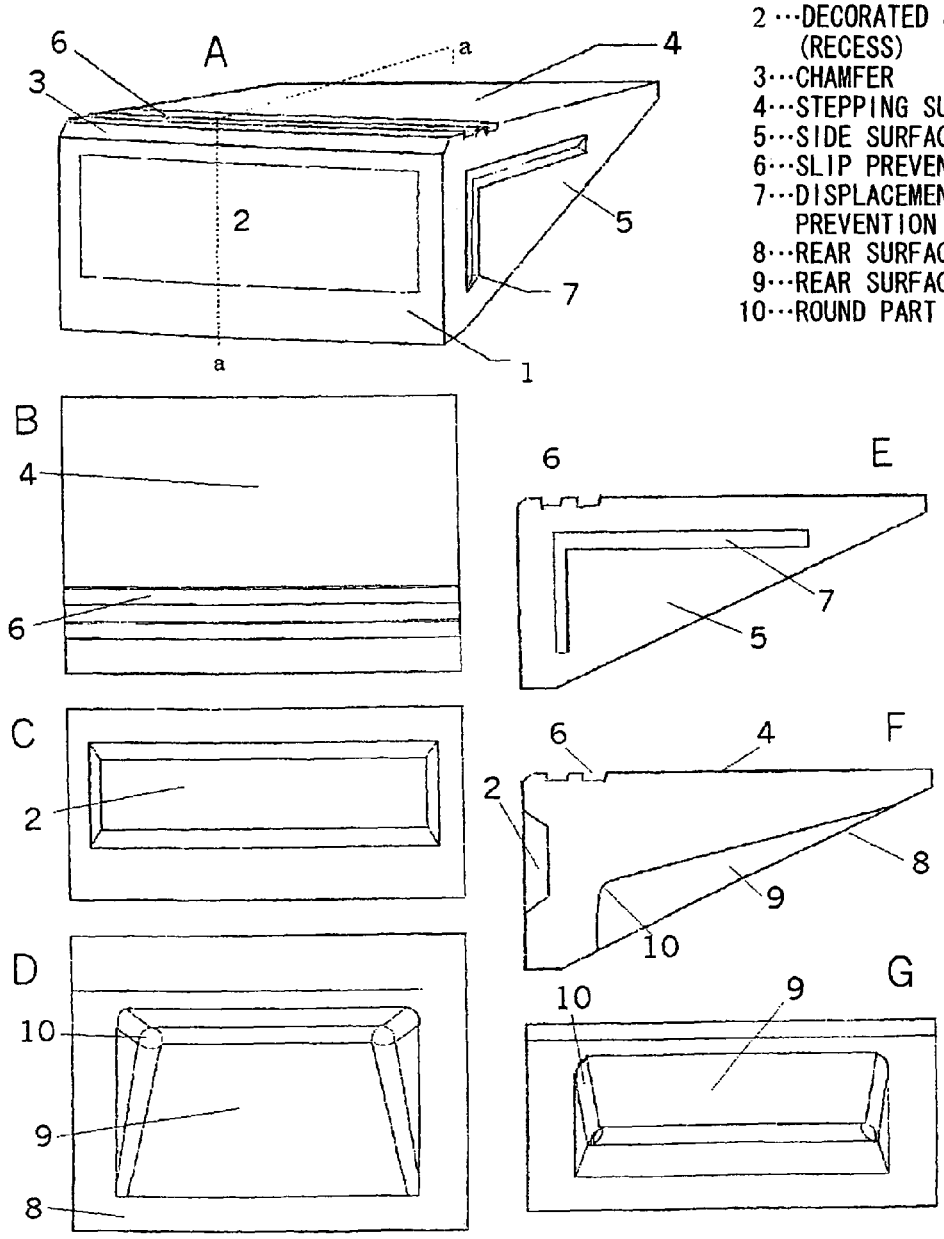
FIG. 1 shows a perspective view, a plan, a front view, a rear view, a side view, a sectional view, and a back-side view of the staircase block as an example of the present invention.
Figure 2:
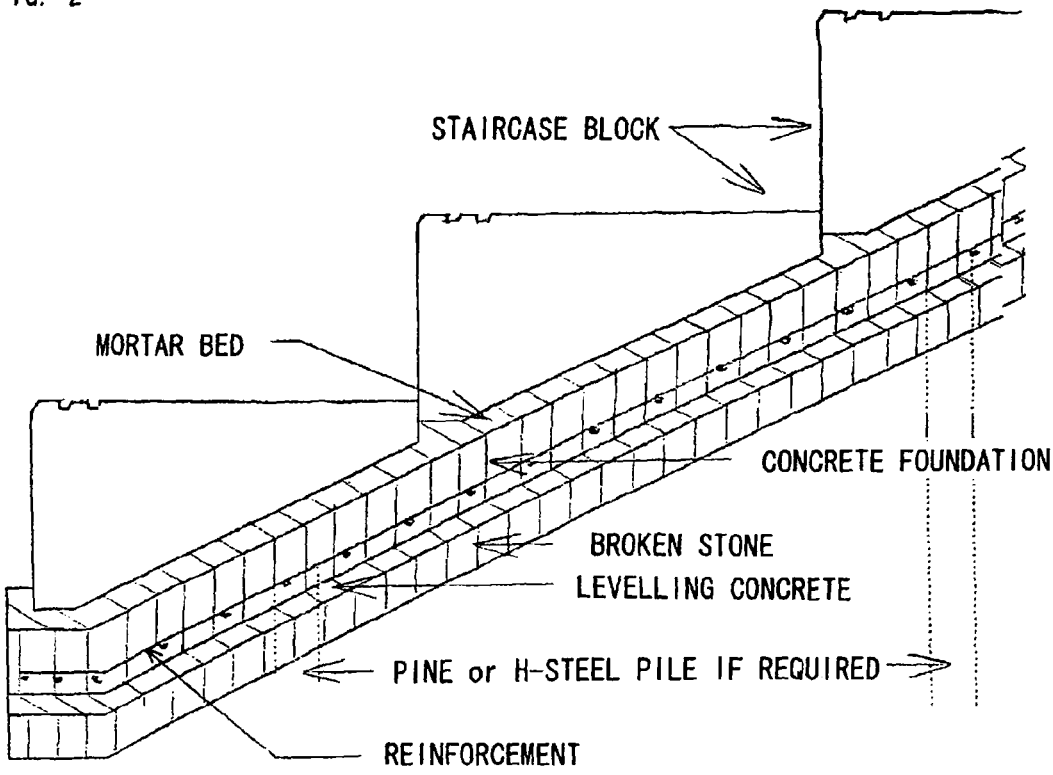
FIG. 2 is a sectional view showing a total structure of a staircase constructed using the staircase block shown in FIG. 1.
Figure 3:
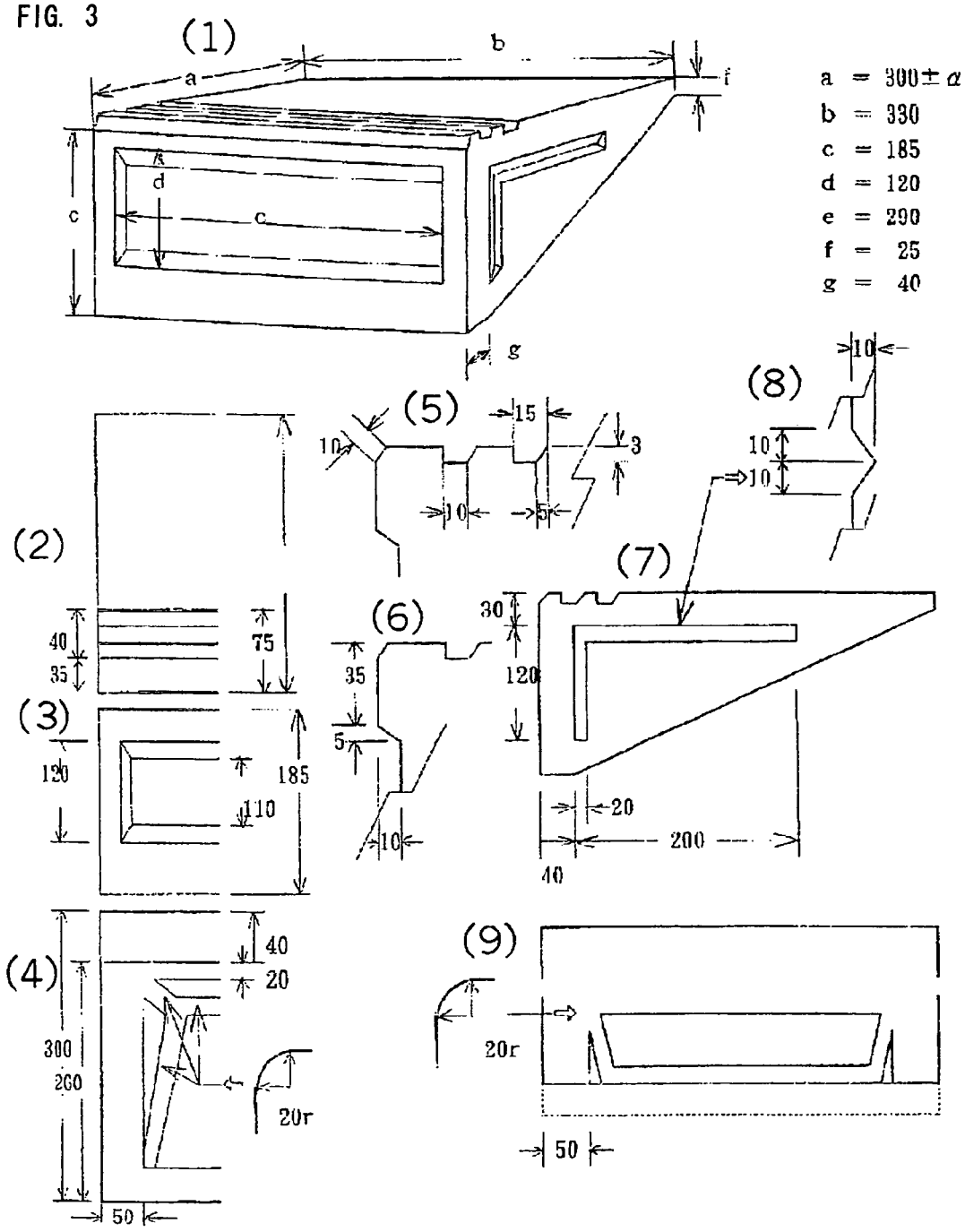
FIG. 3 shows measurements of respective parts of the staircase block.
Figure 4:
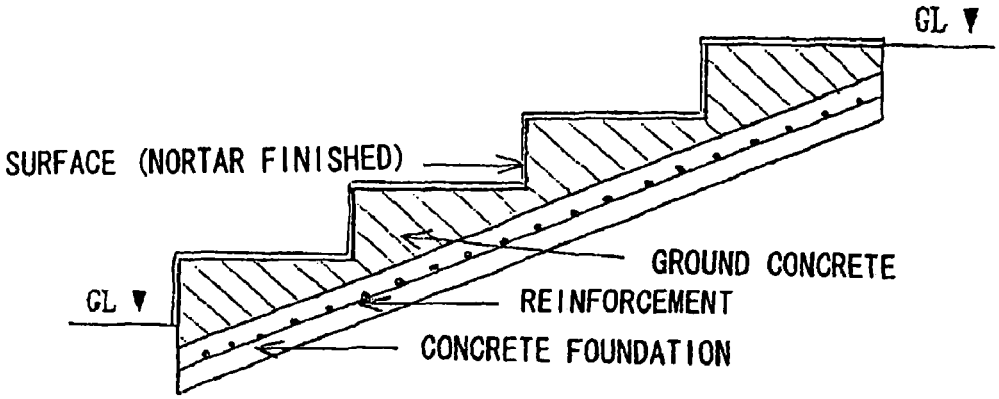
FIG. 4 illustrates the concepts of the conventional staircase construction method.
Figure 5:
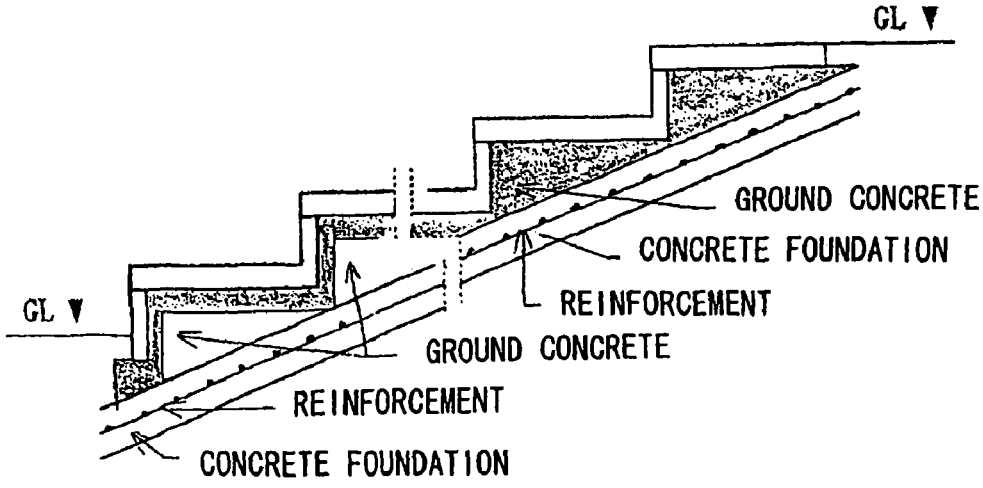
PRIOR ART FIG. 5
FIG. 5 illustrates the concepts of another conventional staircase construction method.

1 rise surface
2 recess in the middle of rise surface
3 chamfer between stepping surface and rise surface
4 stepping surface
5 side surface
6 slip prevention groove
7 displacement prevention groove
8 rear surface
9 recess in rear surface
10 round part

The invention claimed is:

1. A pre-cast concrete block for constructing a staircase, comprising:

a horizontal stepping surface;

a rise surface perpendicular to the stepping surface;

a rear surface which connects diagonally the stepping surface and the rise surface at respective edges thereof, the rear surface having a recess for reducing the weight of the block, the recess having a round part with a specified radius at an inner corner part of the recess between an underside of said horizontal stepping surface and a rear side of said rise surface; and a pair of side surfaces constituting outermost sides of said pre-cast concrete block, each of said pair of side surfaces having a displacement prevention groove formed on an exterior side thereof, wherein said round part forms a partially cylindrical recessed surface, wherein at least part of said pre-cast concrete block has a triangular shape in cross-section, wherein said displacement prevention grooves are formed in an L-shape with a horizontal part and a vertical part, and wherein said displacement prevention grooves have a triangular shape in cross-section.

2. The pre-cast concrete block according to claim 1, further comprising a second recess for reducing the weight of the block, said second recess being formed in the rise surface.

* * * * *